US008075421B2

(12) United States Patent
Hirano

(10) Patent No.: US 8,075,421 B2
(45) Date of Patent: Dec. 13, 2011

(54) GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 567 days.

(21) Appl. No.: 11/790,236

(22) Filed: Apr. 24, 2007

(65) Prior Publication Data

US 2007/0270236 A1 Nov. 22, 2007

(30) Foreign Application Priority Data

May 18, 2006 (JP) ..... 2006-139255

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS 5,346,217 A * 9/1994 Tsuchiya et al. ..... 473/345
6,193,614 B1 * 2/2001 Sasamoto et al. ..... 473/329
6,338,683 B1 * 1/2002 Kosmatka ..... 473/329
6,880,222 B2 * 4/2005 Matsunaga ..... 29/428
6,966,848 B2 * 11/2005 Kusumoto ..... 473/342
7,025,693 B2 * 4/2006 Sugimoto ..... 473/342
7,708,845 B2 * 5/2010 Tetyukhin et al. ..... 148/670
7,878,925 B2 * 2/2011 Ogawa ..... 473/342

FOREIGN PATENT DOCUMENTS

JP 05295502 A * 11/1993
JP 11244427 A * 9/1999
JP 2002-165906 A 6/2002
JP 2002325870 A * 11/2002

* cited by examiner

*Primary Examiner* — Alvin Hunter
(74) *Attorney, Agent, or Firm* — Birch, Stewart, Kolasch & Birch, LLP

(57) ABSTRACT

A golf club head comprises a face portion of which front face defines a club face, wherein at least a part of the face portion is formed by a unidirectionally rolled plate of a titanium alloy having alpha phase such as alpha titanium alloys and alpha+beta titanium alloys, and the unidirectional rolled direction of the plate is oriented in the toe-heel direction of the head. At least 50% in area of the face portion is formed by the unidirectionally rolled plate. The angle (theta) between the rolled direction and the toe-heel direction is not more than 15 degrees.

19 Claims, 10 Drawing Sheets

E 1 Section

GOLF CLUB HEAD

BACKGROUND OF THE INVENTION

The present invention relates to a golf club head, more particularly to a structure of the face portion capable of improving the durability.

In Japanese patent application publication No. 2002-165906, there is disclosed a wood-type hollow metal golf club head whose face portion is formed from a metal plate rolled in two or more different directions. This prior art teaches that if the rolled direction is one direction, the rolled plate is decreased in the resistance to bending deformation in a specific direction, and that when the rolled direction is aligned with the heel-and-toe direction of the head, the face portion is decreased in the durability. But, in the case of a metal plate rolled in two or more directions and thus having less anisotropy, the durability of the face portion can be improved and yet it becomes not necessary to concern the orientation of the metal plate. Further, it is suggested that the metal plate is preferably formed from a beta titanium alloy by cold rolling.

The inventor made a study and found that the durability of the face portion can be improved by specifically orienting a unidirectionally rolled titanium alloy having alpha phase in spite of the one rolled direction, and accordingly the manufacturing cost and efficiency can be improved.

SUMMARY OF THE INVENTION

It is an object of the present invention to provide a golf club head in which the durability of the face portion can be improved.

According to the present invention, a golf club head comprises a club face formed by a unidirectionally rolled plate of a titanium alloy having alpha phase, and the unidirectional rolled direction of the plate is oriented in the toe-heel direction of the head.

As shown in FIG. 16, an alpha phase crystal has a hexagonal closely packed structure, and this structure has an axis (a) in which the structure is easily deformable and an axis (b) being orthogonal thereto in which the structure is hardly deformable. In the unidirectionally rolled plate, the axis (a) is oriented in the rolled direction, and the axis (b) is oriented in the perpendicular direction to the rolled direction. As a result, the unidirectionally rolled plate exhibits a remarkable anisotropy, and the tensile strength in the perpendicular direction to the rolled direction becomes higher than the tensile strength in the rolled direction, and the tensile elastic modulus in the perpendicular direction to the rolled direction becomes higher than the tensile elastic modulus in the rolled direction.

On the other hand, generally the width of the face portion in the toe-heel direction is larger than the height in the crown-sole direction. Therefore, as to the strength against the flexure of the face portion at impact, the margin of the strength in the crown-sole direction becomes smaller than the margin of the strength in the toe-heel direction.

Therefore, by orienting the rolled direction in the toe-heel direction, the face portion is increased in the margin of the strength in the crown-sole direction, and the durability of the face portion as a whole can be improved.

In addition, the club head has further advantages. As the strength margin of the face portion is increased, it becomes possible to decrease the thickness of the face portion. If the thickness of the face portion is decreased, as the weight of the face portion is decreased, the weight margin of the head can be increased. Thus, the freedom of designing the weight distribution is increased, which enables to lower and deepen the center of gravity.

Further, as the direction of the plate in which the tensile elastic modulus becomes large is oriented in the crown-sole direction, even if the face portion is decreased in the thickness, an excessive increase in the coefficient of restitution can be avoided. Therefore, it is possible to conform to the golf rules change that restricts the coefficient of restitution of club heads to 0.830 or less.

DESCRIPTION OF THE PREFERRED EMBODIMENTS

Figure 1:
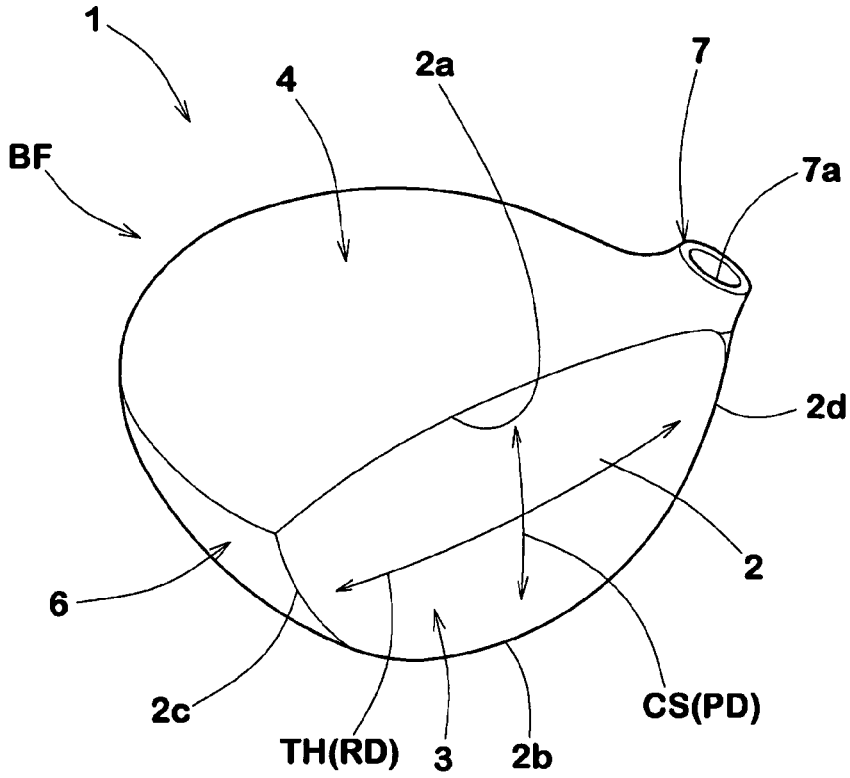
FIG. 1 is a perspective view of a wood-type golf club head according to the present invention.

Embodiments of the present invention will now be described in detail in conjunction with the accompanying drawings.

In the drawings, golf club head 1 according to the present invention is a hollow head for a wood-type golf club such as driver (#1) or fairway wood, and the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. Thus, the club head 1 is provided with a hollow (i) and a shell structure with the thin wall.

In the following description, the dimensions refer to the values measured under the standard state of the club head unless otherwise noted.

Here, the standard state of the club head 1 is such that the club head is set on a horizontal plane HP so that the axis of the club shaft (not shown) is inclined at the lie angle (beta) while keeping the center line on a vertical plane VP, and the club face 2 forms its loft angle (alpha) with respect to the horizontal plane HP. Incidentally, in the case of the club head alone, the center line of the shaft inserting hole 7*a* can be used instead of the axis of the club shaft.

The undermentioned sweet spot Ss is the point of intersection between the club face 2 and a straight line N drawn normally to the club face 2 passing the center G of gravity of the head. The back-and-forth direction is a direction parallel with the straight line N projected on the horizontal plane HP. The toe-heel direction TH is a direction parallel with the horizontal plane HP and perpendicular to the back-and-forth direction. The crown-sole direction CS is a direction perpendicular to the toe-heel direction TH, namely, a vertical direction. The moment of inertia is the lateral moment of inertia around a vertical axis passing through the center G of gravity in the standard state.

Figure 14:
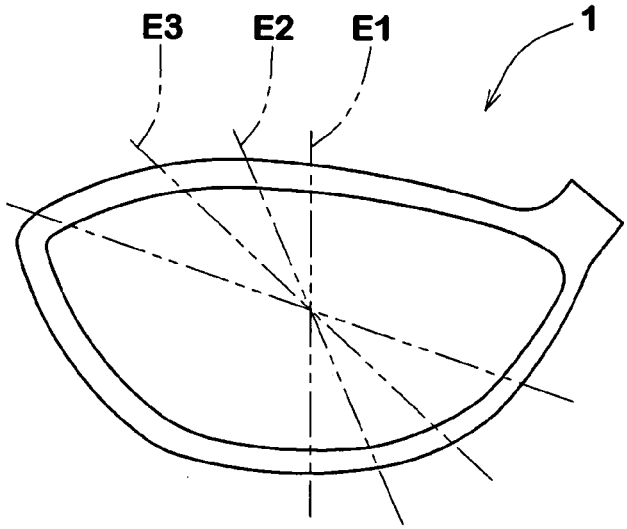
FIG. 14 and FIG. 15 are a front view and a partial cross sectional view of the face portion, respectively, for explaining the definition of the extent of the face portion.
Figure 15:
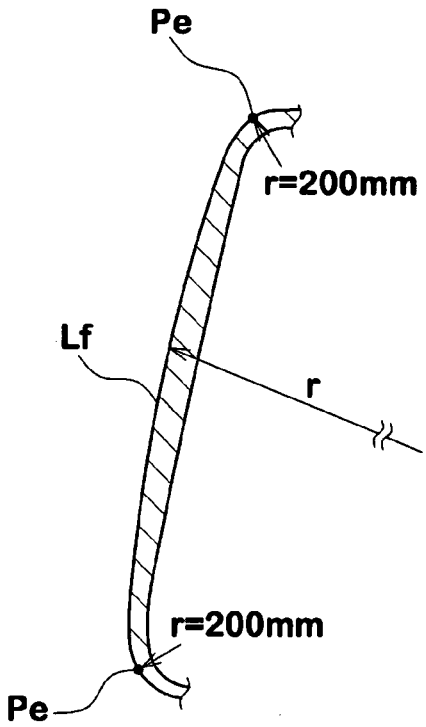

If the edge (2*a*, 2*b*, 2*c* and 2*d*) of the club face 2 is unclear due to smooth change in the curvature, a virtual edge line (Pe) which is defined, based on the curvature change is used instead as follows. As shown in FIGS. 14 and 15, in each cutting plane E1, E2—including the straight line N extending between the sweet spot SS and the center G of gravity of the head, as shown in FIG. 15, a point Pe at which the radius (r) of curvature of the profile line Lf of the face portion first becomes under 200 mm in the course from the center SS to the periphery of the club face is determined. Then, the virtual edge line is defined as a locus of the points Pe.

In the case of a wood-type club head for a driver (#1), it is preferable that the head volume is set in a range of not less than 400 cc, more preferably not less than 410 cc, still more preferably not less than 425 cc in order to increase the moment of inertia and the depth of the center of gravity. However, to prevent an excessive increase in the club head weight and deteriorations of swing balance and durability and further in view of golf rules or regulations, the head volume is preferably set in a range of not more than 460 cc. The mass of the club head 1 is preferably set in a range of not less than 180 grams in view of the swing balance and rebound performance, but not more than 210 grams in view of the directionality and traveling distance of the ball.

Figure 2:
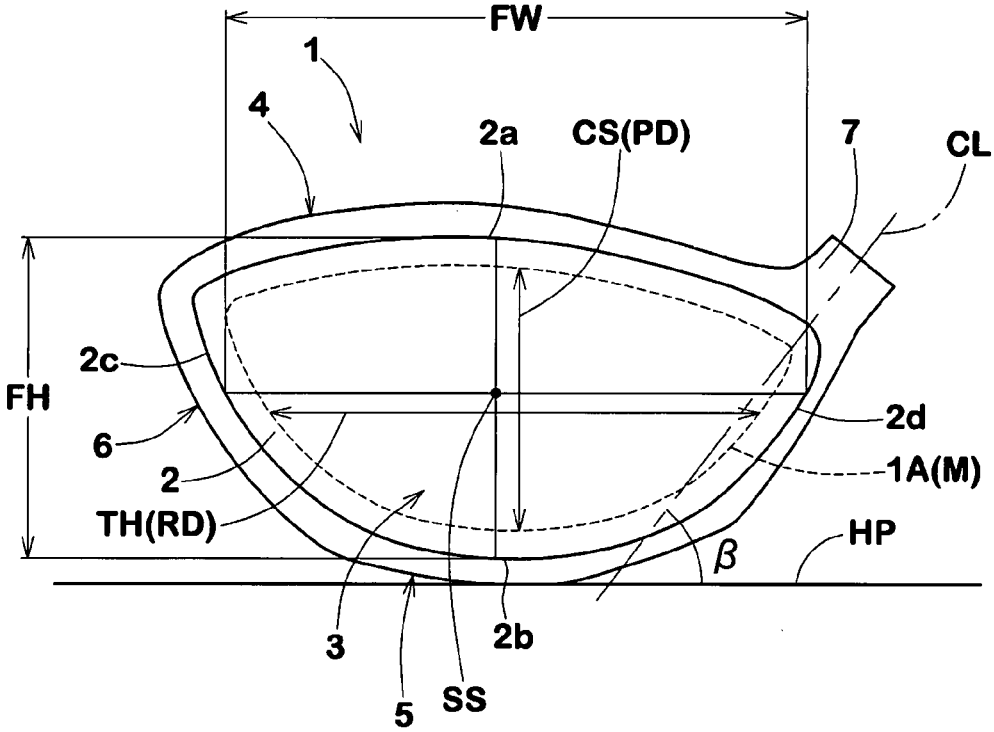
FIG. 2 is a front view thereof.
Figure 3:
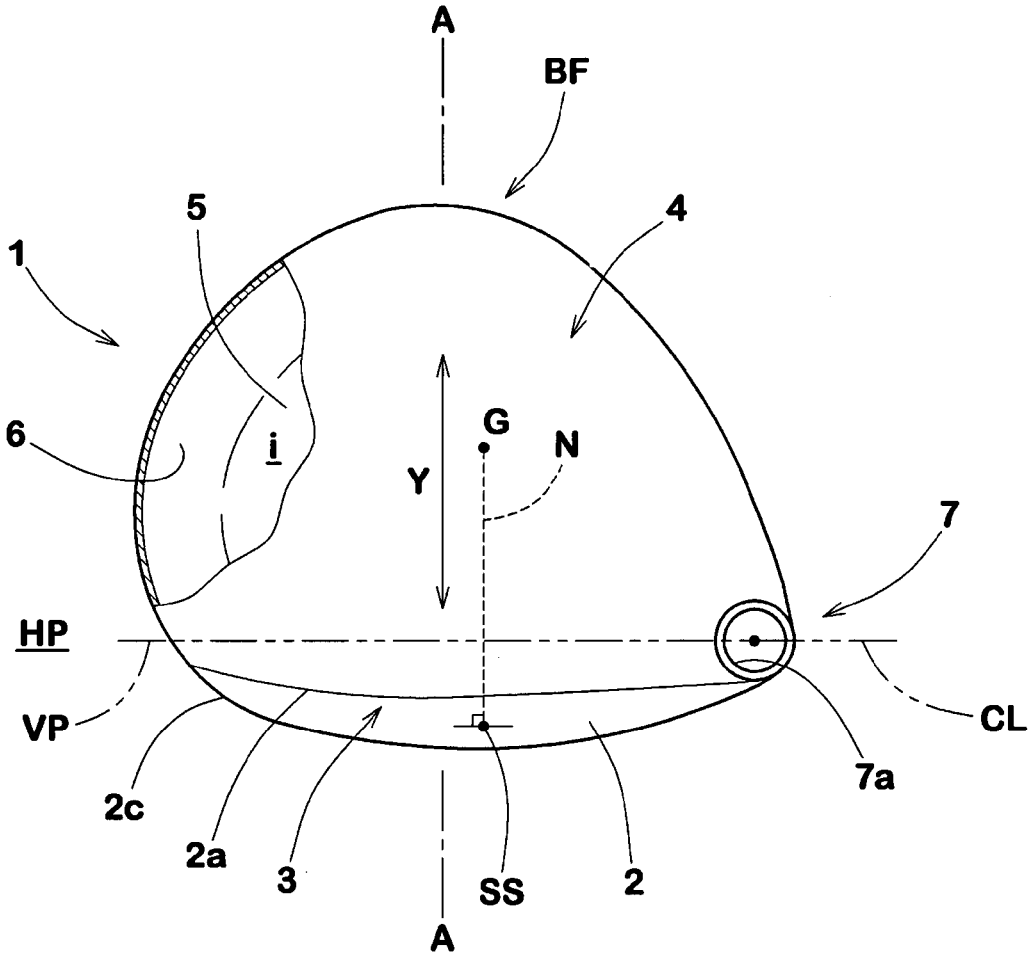
FIG. 3 is a top view thereof.

As shown in FIG. 2, when viewed from the front, the club face 2 has a shape wider than is height.

The width FW of the club face 2, which is measured in the toe-heel direction along the club face 2 passing through the sweet spot SS, is preferably not less than 90.0 mm, more preferably not less than 92.0 mm, still more preferably not less than 95.0 mm, but not more than 110.0 mm, more preferably not more than 107.0 mm, still more preferably not more than 105.0 mm.

The height FH of the club face 2, which is measured in the crown-sole direction CS along the club face 2 passing through the sweet spot SS, is preferably not less than 48.0 mm, more preferably not less than 50.0 mm, still more preferably not less than 52.0 mm, but not more than 60.0 mm, more preferably not more than 58.0 mm, still more preferably not more than 56.0 mm.

Preferably, the ratio (FW/FH) is not less than 1.65, more preferably not less than 1.70, still more preferably not less than 1.80 in order to lower the center G of gravity. However, if the ratio (FW/FH) is too large, the rebound performance greatly deteriorates. Therefore, the ratio (FW/FH) is preferably not more than 2.10, more preferably not more than 2.05, still more preferably not more than 2.00.

In this embodiment, the club head 1 is composed of a face plate 1A forming at least a part of the face portion 3, and a main shell body 1B forming the remainder of the head.

Figure 4:
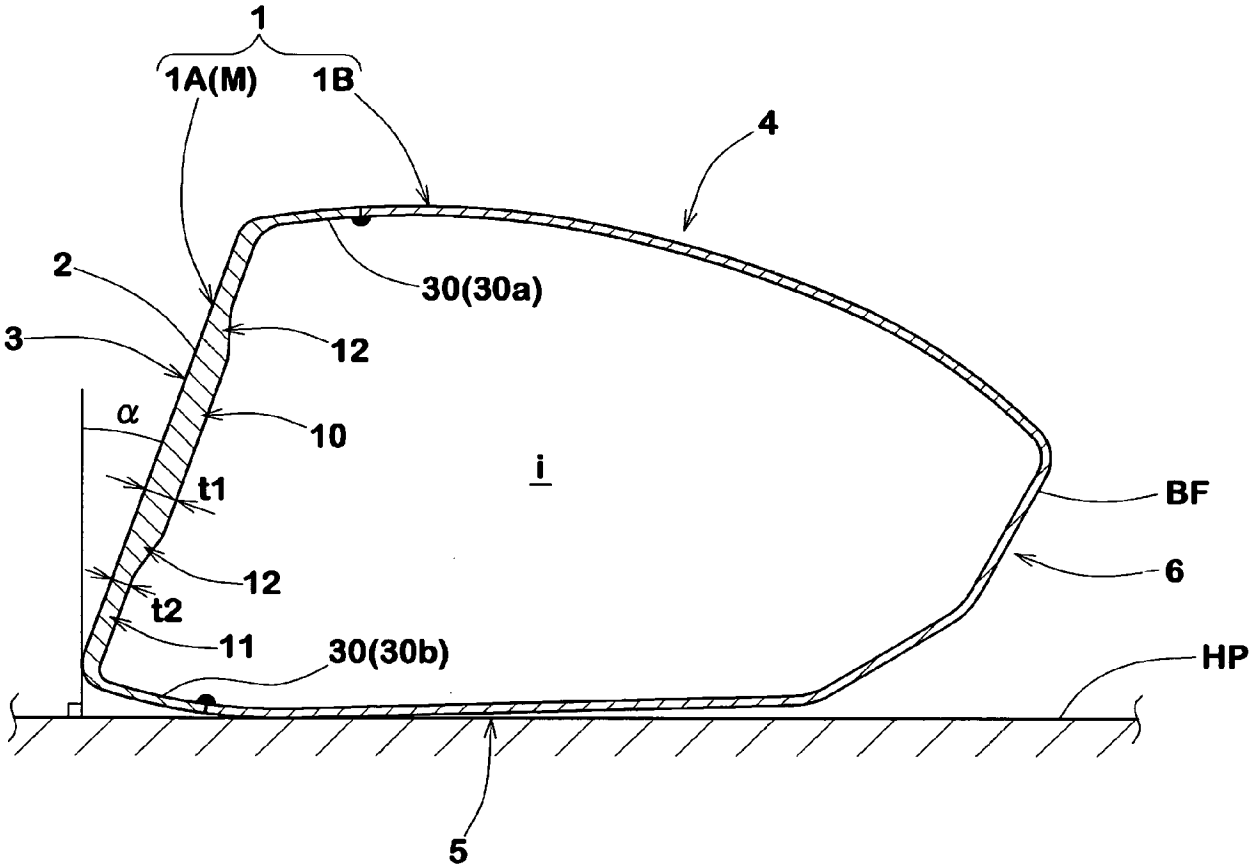
FIG. 4 is a cross sectional view of an embodiment of the present invention taken on line A-A in FIG. 3.

In the case of an example shown in FIG. 4 in which the face plate 1A is provided around its main portion with a turnback 30, the entirety of the face portion 3 is formed by the face plate 1A. The turnback 30 in this example is formed along the almost entire length of the edge (2*a*, 2*b*, 2*c* and 2*d*) of the club face 2. But, it is also possible to form partially, for example, along the upper edge 2*a* and lower edge 2*b* to form a front end zone of the crown portion 4 and a front end zone of the sole portion 5.

Figure 5:
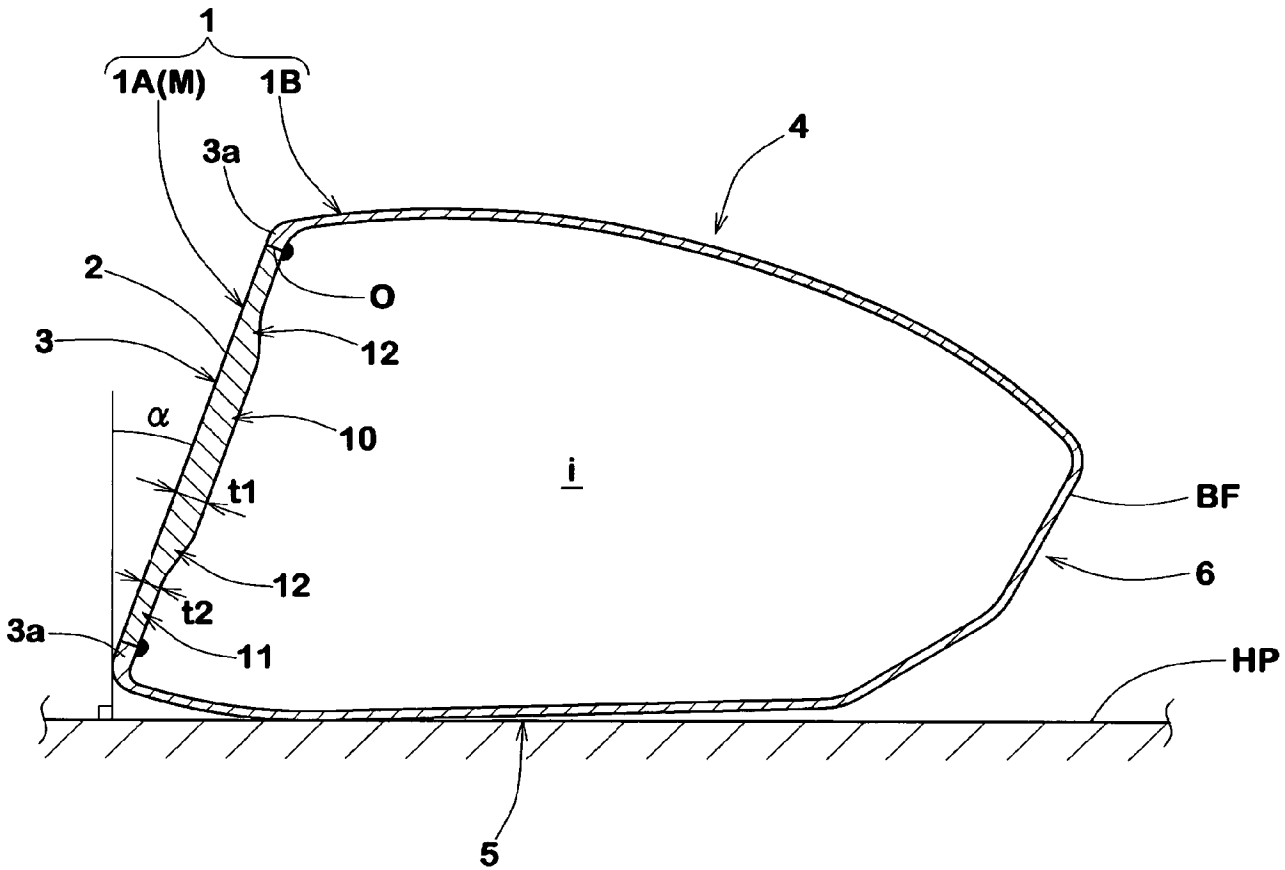
FIG. 5 is a cross sectional view of another embodiment of the invention taken on line A-A in FIG. 3.

In the case of an example shown in FIG. 5 in which the face plate 1A is provided with no turnback, the face plate 1A forms a major part of the face portion 3 excluding the peripheral edge part 3*a* thereof. In this case, it is necessary that the face plate 1A forms at least 50% (preferably 60% or more, more preferably 70% or more, (in FIG. 2 about 75%)) of the total surface area of the club face 2. In this example, the face plate 1A has a contour of a similar figure to that of the club face 2.

The main shell body 1B is hollow and provided with a front opening O which is covered with the face plate 1A.

In the case of FIG. 5, the main shell body 1B includes the above-mentioned crown portion 4, sole portion 5, side portion 6 and hosel portion 7. Further, the peripheral edge part 3*a* is also included. In the case of FIG. 4, the main shell body 1B includes a major part of the head excluding the face portion and a portion corresponding to the turnback 30.

The main shell body 1B can be a single-piece structure formed by casting or the like. Also, it can be a multi-piece structure formed by assembling two or more parts prepared by suitable processes, e.g. forging, casting, press working and the like.

To make the main shell body 1B, for example, stainless steels, maraging steels, pure titanium, titanium alloys, aluminum alloys, magnesium alloys, amorphous alloys and the like can be used alone or in combination.

A metal material weldable with the face plate 1A is preferred in view of the production efficiency. In addition, a lightweight nonmetal material such as fiber reinforced resins can be used to form a part of the main shell body 1A. A separate weight member can be disposed on the main shell body 1A.

The face plate 7 is made of a unidirectionally rolled plate M of a titanium alloy having alpha phase, and the rolled direction RD is substantially aligned with the toe-heel direction TH. The angle theta between the rolled direction RD and the toe-heel direction TH (cf. FIGS. 6*a*-6*c*) is not more than 15 degrees, preferably not more than 10 degrees.

Here, the titanium alloy having alpha phase is an alpha alloy or an alpha+beta alloy. The alpha+beta alloys include Ti-4.5 Al-3V-2Fe-2Mo, Ti-4.5Al-2Mo-1.6V-0.5Fe-0.3Si-0.03C, Ti-1Fe-0.35O-0.01N, Ti-8Al-1Mo, Ti-5.5Al-1Fe, Ti-6Al-4V, Ti-6Al-6V-2Sn, Ti-6Al-2Sn-4Zr-6Mo, Ti-6Al-2Sn-4Zr-2Mo, Ti-8Al-1Mo-1V and the like. Especially, the first three alloys are preferred because of a high specific tensile strength, and an excellent formability. A typical alpha alloy is Ti-5Al-2.5Sn.

As the alpha+beta alloys are higher in the strength than the alpha alloys, the alpha+beta alloys are especially preferable to the alpha titanium alloys because the durability of the face portion 3 can be improved, and by decreasing the thickness of the face plate 1A, the weight can be reduced and further the freedom of designing the position of the center of gravity can be increased.

The unidirectionally rolled plate M has a tensile strength Srd and a tensile elastic modulus Erd in the rolled direction RD. In the perpendicular direction PD to the rolled direction, the unidirectionally rolled plate M has a different tensile strength Spd and a different tensile elastic modulus Epd.

On the assumption that the face plate 1A forms more than 60%, preferably more than 70% of the face portion, if the ratio (Epd/Erd) and/or ratio (Spd/Srd) are too small, it becomes difficult to improve the durability of the face portion 3. If too large, the face portion is decreased in the strength in the toe-heel direction and the durability decreases.

Therefore, the tensile strength ratio (Spd/Srd) is preferably set in a range of not less than 1.20, more preferably not less than 1.25, still more preferably not less than 1.30, but not more than 1.60, more preferably not more than 1.50, still more preferably not more than 1.45.

The elastic modulus ratio (Epd/Erd) is preferably set in a range of not less than 1.10, more preferably not less than 1.14, still more preferably not less than 1.18, but not more than 1.35, more preferably 1.30, still more preferably not more than 1.25.

If the tensile strength Srd and Spd is too small, the strength of the face portion 3 becomes insufficient, and the face portion is liable to broken early due to metal fatigue. If the tensile elastic modulus Epd and Erd is too small, the coefficient of restitution of the head becomes so high and incompatible with the golf rules or regulations.

If the tensile strength Srd and Spd becomes too large, there is a tendency that the tensile elastic modulus Epd and Erd also becomes too large, therefore, the coefficient of restitution becomes very small.

Therefore, the tensile strength Spd is preferably set in a range of not less than 1000 MPa, more preferably not less than 1100 MPa, still more preferably not less than 1150 MPa, but not more than 1400 MPa, more preferably not more than 1350 MPa, still more preferably not more than 1300 MPa.

The tensile strength Srd is preferably set in a range of not less than 800 MPa, more preferably not less than 850 MPa, still more preferably not less than 900 MPa, but not more than 1200 MPa, more preferably not more than 1100 MPa, still more preferably not more than 1050 MPa.

The tensile elastic modulus Epd is preferably set in a range of not less than 115 GPa, more preferably not less than 120 GPa, still more preferably not less than 125 GPa, but not more than 145 GPa, more preferably not more than 140 GPa, still more preferably not more than 135 GPa.

The tensile elastic modulus Erd is preferably set in a range of not less than 95 GPa, more preferably not less than 100 GPa, still more preferably not less than 105 GPa, but not more than 125 GPa, more preferably not more than 120 GPa, still more preferably not more than 118 GPa.

Figure 7:
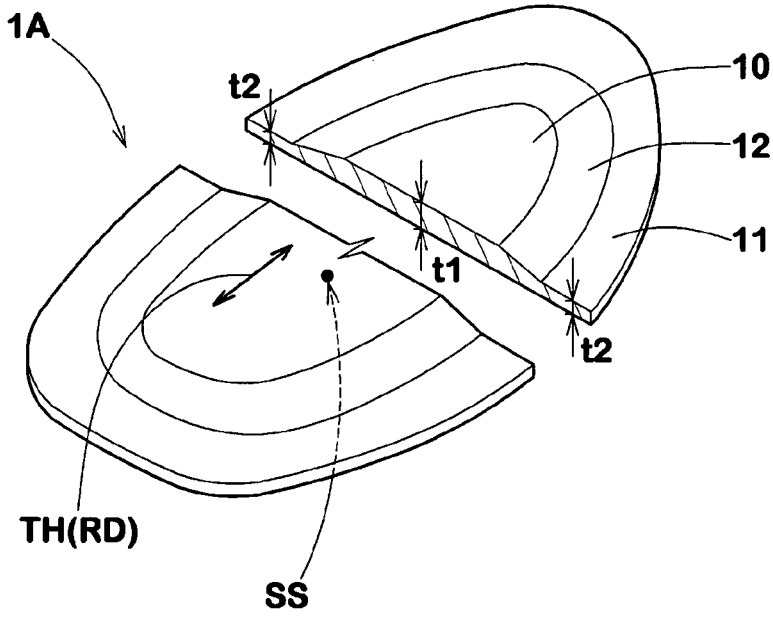
FIG. 7 is a perspective view showing an example of the backside of the face portion.
Figure 16:
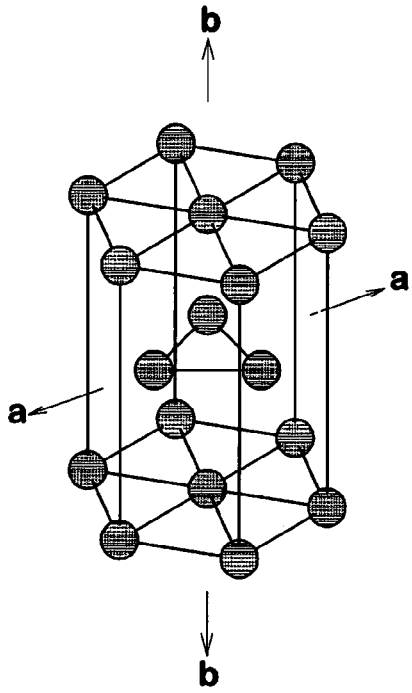
FIG. 16 is a diagram showing a hexagonal closely packed crystal lattice or structure.

FIG. 7 shows the rear surface of the face portion 3 in the embodiments shown in FIGS. 4 and 5, wherein the face portion 3 is provided with a thicker central part 10 and a resultant thin annular part 11 surrounding the central part 10.

The thicker central part 10 has a contour of a similar figure to that of the face portion, and positioned such that the center (centroid) thereof becomes near or at the sweet spot SS.

The thicker central part 10 has a substantially constant thickness t1. The thickness t1 is preferably set in a range of not less than 2.80 mm, more preferably not less than 2.90 mm, still more preferably not less than 2.95 mm in view of the strength and durability, but in view of the weight increase and rebound performance, the thickness ti is preferably not more than 3.30 mm, more preferably not more than 3.20 mm, still more preferably not more than 3.15 mm.

The thin part 11 has a substantially constant thickness t2. As the peripheral part, namely, the thin part 11 has little occasion to hit a ball, the thickness can be decreased to reduce the weight of the face portion 3 and at the same time to increase the flexure of the face portion at impact to improve the rebound performance. Therefore, the thickness t2 is preferably set in a range of not more than 2.60 mm, more preferably not more than 2.50 mm, still more preferably not more than 2.45 mm. But, in view of the durability, the thickness t2 is preferably not less than 2.10 mm, more preferably not less than 2.20 mm, still more preferably not less than 2.25 mm.

Between the thicker central part 10 and thin part 11, in order to prevent a stress concentration, there is provided with a transitional zone 12 in which the thickness gradually changes from the thickness t1 of the thicker part 10 to the thickness t2 of the thin part 11.

The average thickness ta of the face portion 3 is preferably not less than 2.35 mm, more preferably not less than 2.40 mm, still more preferably not less than 2.45 mm for the strength and durability and to prevent an excessive increase of the coefficient of restitution. But, to prevent an excessive decrease of the coefficient of restitution and a decrease of the moment of inertia, the average thickness ta is preferably not more than 2.75 mm, more preferably not more than 2.70 mm, still more preferably not more than 2.65 mm.

Here, the average ta is an area weighted average which can be obtained by $$ta = \frac{\Sigma(Tn \times An)}{\Sigma An}$$

$$(n = 1, 2, \ldots)$$

wherein

An is the area of a minute part (n), and

Tn is the thickness of the minute part (n).

Figure 8:
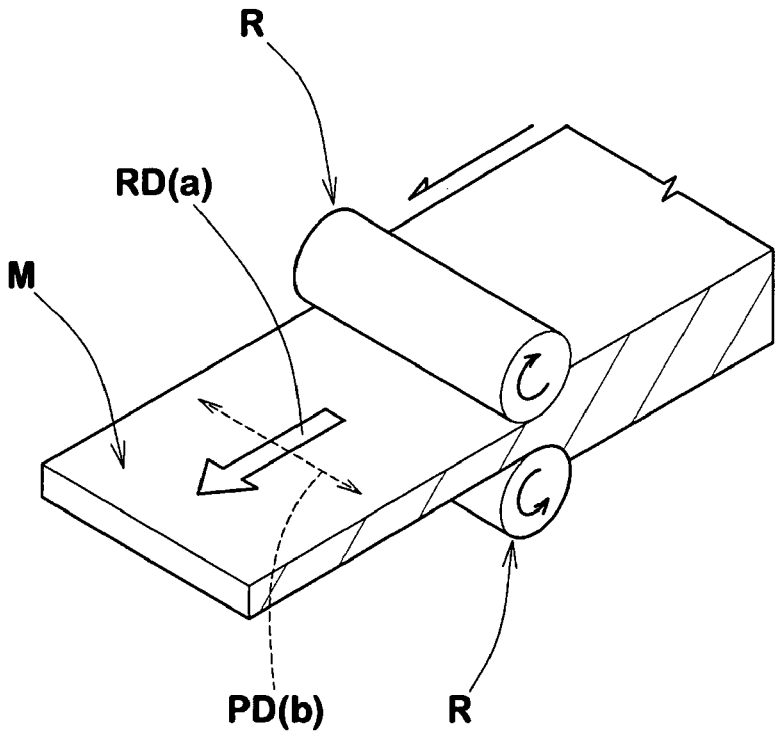
FIG. 8 is a schematic perspective view for explaining a unidirectionally rolled plate.

The unidirectionally rolled plate M is, as shown in FIG. 8, produced by passing the above-mentioned titanium alloy material through between opposed pressure rollers R plural times without changing the passing direction.

when rolled in only one direction, in comparison with the beta titanium alloys, a titanium alloy having alpha phase displays a significant anisotropy in the strength. In order to utilize this strength anisotropy, the rolled direction RD of the unidirectionally rolled plate M is oriented in the toe-heel direction TH.

The rolling process may be worked out with one or the other of hot rolling and cold rolling which are defined as being carried out with the material temperature of over 200 degrees C. and under 200 degrees C., respectively. But, it is desirable that the hot rolling and cold rolling are combined as follows: firstly, hot rolling is carried-out 2 to 7 times by heating the material up to a temperature range between 700 and 1000 degrees C.; and then, cold rolling is carried out 5 to 7 times at the material temperature in a range of from under 200 degrees C. to ambient temperature.

In any case, the total number of times to roll is preferably not less than 7, more preferably not less than 9, but not more than 15, more preferably not more than 12.

The rolling ratio is preferably not less than 20%, more preferably not less than 25%, still more preferably not less than 30%, but, not more than 50%, more preferably not more than 45%, still more preferably not more than 40%. Here, the rolling ratio (%) is:

$$(h1-h2)\times 100/h1$$

wherein h1 is the thickness before rolled, and h2 is the finished thickness of the rolled plate.

Therefore, crystal grains which are inhomogeneous structures and deposited metals in the rolled plate are fractured, and the crystalline structure of the rolled plate is compacted. As a result, the strength and toughness can be improved.

If the rolling ratio is less than 20%, the crystal grains as inhomogeneous structures and deposited metals in the rolled plate can not be fully fractured. Further, the orientation of the hexagonal closely packed crystal structures becomes insufficient. Therefore, the strength anisotropy becomes weak. If the rolling ratio is more than 50%, the rolled plate becomes brittle and liable to crack.

If the total number of times to roll is less than 7, the crystalline structure of the rolled plate can not be fully homogenized and there is a possibility that the strength anisotropy can not be fully displayed. If the total number is more than 15, the surface of the rolled plate tends to be covered with a thick oxidized film because the titanium alloy is active.

Incidentally, the material to be rolled can be prepared by various ways, e.g. fusion casting, forging, and the like. It is possible that the material undergoes a heat treatment, machine work and the like.

Figure 9:
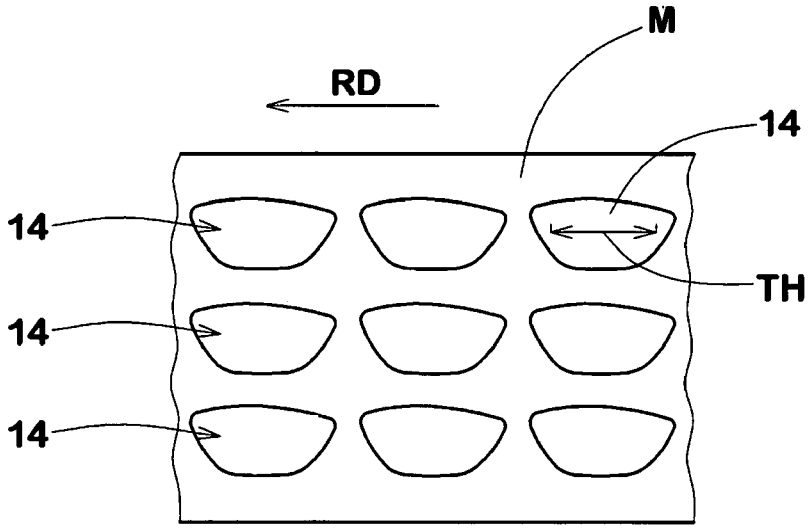
FIG. 9 is a schematic view for explaining a method of making a face plate from the unidirectionally rolled plate.

As shown in FIG. 9, from the unidirectionally rolled plate M, primary face plates 14 are formed by utilizing punch cutting die, laser cutting or the like so that the toe-heel direction TH is aligned with the rolled direction RD.

The unidirectionally rolled plate M has a constant thickness. Therefore, in the case of the face portion 3 having the above-mentioned variable thickness, in order to change the thickness, cutting, plastic forming or the like can be utilized.

In the case of cutting, for example, using a NC milling machine, the primary face plate 14 is partially reduced in the thickness to form the thin part 11 and thickness transitional zone 12.

Figure 10:
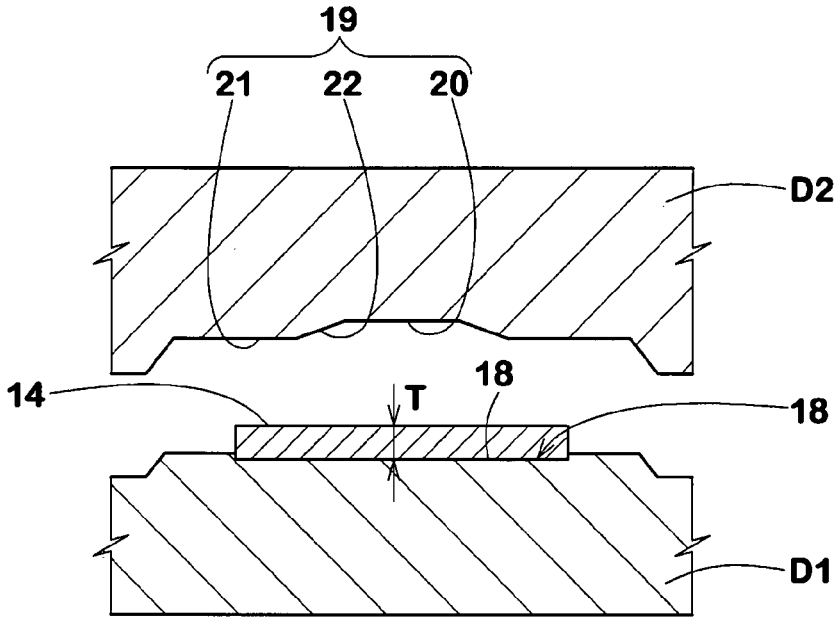
FIG. 10 and FIG. 11 are cross sectional views for explaining a process of forming the face plate of the embodiment shown in FIG. 5.
Figure 11:
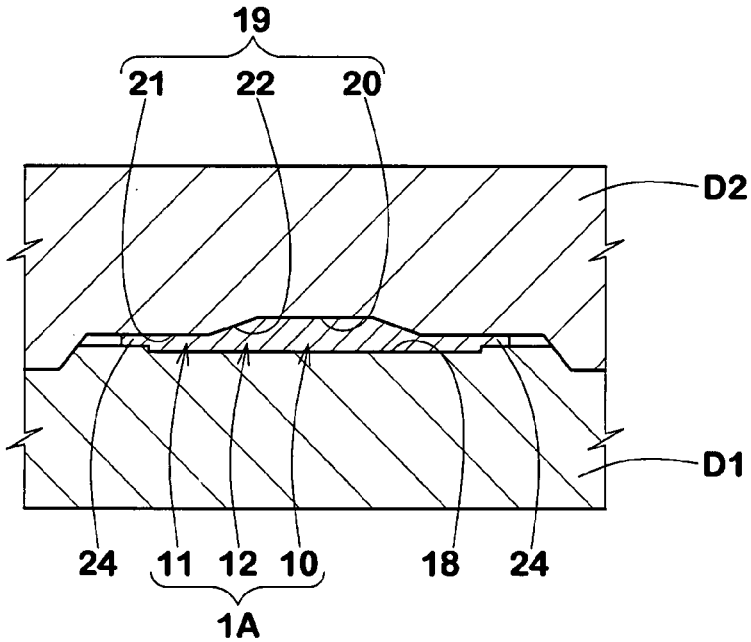

In the case of plastic forming, the thin part 11 and thickness transitional zone 12 can be formed by using a pressing machine comprising a lower press die D1 and an upper press die D2 as shown in FIGS. 10 and 11. The lower press die D1 is provided with a first surface 18 for shaping the club face. The first surface 18 is recessed, and the primary face plate 14 can be fitted therein. The upper press die D2 is provided with a second surface 19 for shaping the rear surface of the face portion 3. Therefore, The second surface 19 includes a surface 20 for shaping the thicker central part 10, a surface 21 for shaping the thin part 11, and a surface 22 for shaping the thickness transitional zone 12.

The primary face plate 14 is placed between the first surface 18 and second surface 19 and compressed so that the thickness is reduced in the thin part 11 and transitional zone 12. The surplus material may be extruded as an extrusion 24.

When the club face 2 has a bulge and/or a roll, the first surface 18 and second surface 19 are curved correspondingly. It is of course also possible to provide the bulge and/or roll in a separate process before or after this plastic forming process.

Likewise, in the former case, the bulge and/or roll can be provided before or after, preferably before the cutting process, utilizing a die press machine.

FIGS. 10 and 11 show the dies for the face plate 1A shown in FIG. 5.

Figure 12:
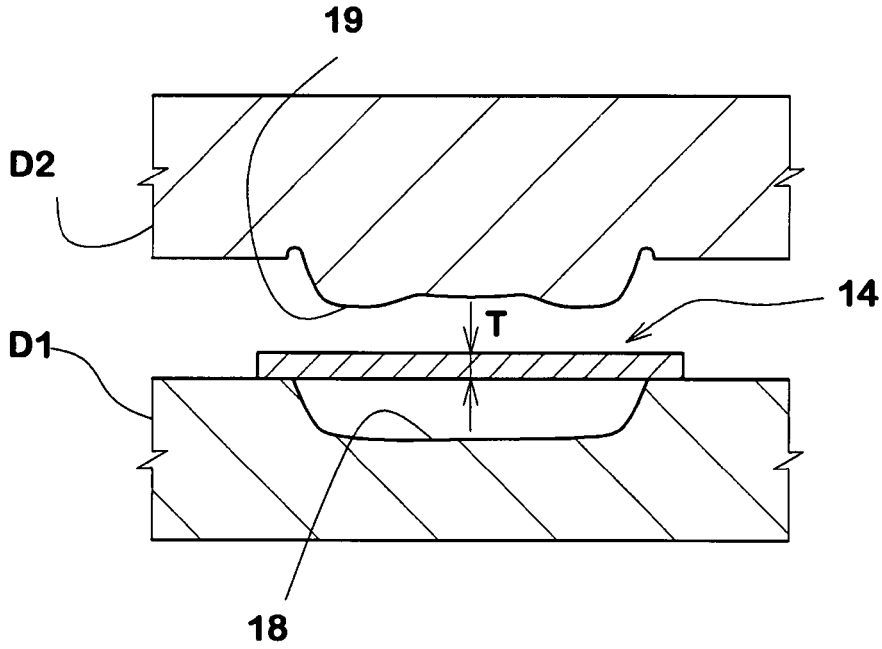
FIG. 12 and FIG. 13 are cross sectional views for explaining a process of forming the face plate of the embodiment shown in FIG. 4.
Figure 13:
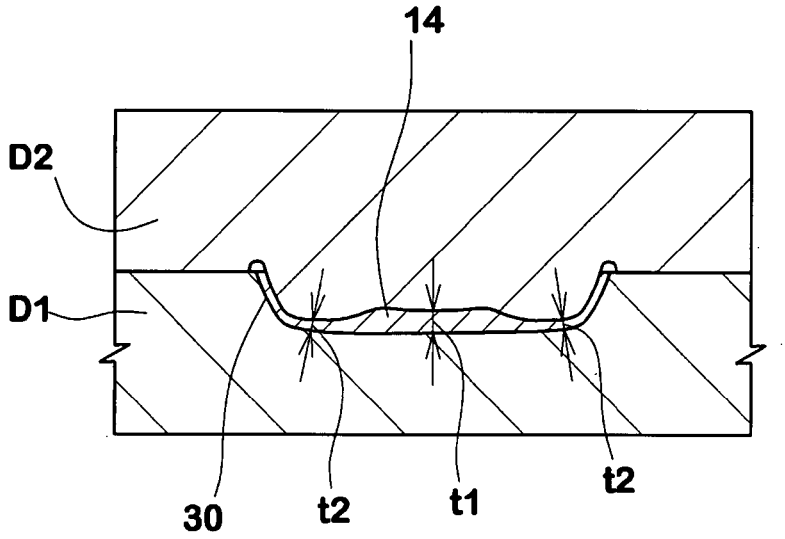

In the case of the face plate 1A provided with the turnback 30 shown in FIG. 4, as shown in FIGS. 12 and 13, the dies D1 and D2 having shaping surfaces 18 and 19 corresponding to the shape of such cup-type face plate 1A are used.

The turnback 30 forms a front end zone 30*a* of the crown portion 4 and a front end zone 30*b* of the sole portion 5. In these zones 30*a* and 30*b*, as the perpendicular direction PD is oriented in the back-and-forth direction, the strength margin can be increased and the durability of the club head 1 may be further improved.

In the plastic forming, the thin part 11 and thickness transitional zone 12 make compressive deformation more than the thicker central part 10. Thus, the anisotropy of the thin part 11 is furthered, and the strength of the thin part 11 is increased. As a result, the face portion 3 as a whole is further improved in the strength. Further, by the compressed deformation, the face portion 3 is increased in the elastic modulus, which can prevent the coefficient of restitution from increasing. Thus, even if the face portion 3 is decreased in the thickness, it is possible to conform to the golf rules change.

The face plate 1A and main shell body 1B produced as above are fixed to each other. For that purpose, welding (Tig welding, plasma welding, laser welding, etc.), soldering, press fitting and the like can be used alone or in combination. Especially, laser welding is preferred.

comparison Tests

Wood club heads (Loft angle alpha: 11 degrees, Lie angle beta: 57.5 degrees, Head volume: 450 cc) having the structure shown in FIG. 5 (no turnback) and the specifications shown in Table 1 were made and tested for the rebound performance and durability.

All of the heads had identical main shell bodies which were a lost-wax precision casting of a titanium alloy Ti-6Al-4V. The unidirectionally rolled plate was produced by rolling an alpha+beta titanium alloy Ti-6Al-4V in the following conditions.

1st to 5th rolling: material temperature 840 degrees C.

6th to 11th rolling: material temperature 150 degrees C.

Rolling ratio: 50%

Final thickness of the rolled plate: 3.5 mm

From the unidirectionally rolled plate, primary face plates 14 were punched out, using a blanking die.

In Exs. 1 to 5 and Refs. 1 to 2, the face plate was formed by adjusting the thickness of the primary face plate 14 with a NC milling machine. In Ex. 6, the face plate was formed by adjusting the thickness of the primary face plate 14 with a die press machine as shown in FIGS. 10-11.

The face plate was fixed to the main shell body by plasma arc welding.

Rebound Performance Test

According to the "Procedure for Measuring the velocity Ratio of a club Head for conformance to Rule 4-1e, Appendix II, Revision 2 (Feb. 8, 1999), United states Golf Association", the coefficient of restitution (e) of each club head was obtained. The results are shown in Table 1. The larger the value, the better the rebound performance.

Durability Test

Each head was attached to a FRP shaft (SRI Sports Ltd. v-25, Flex x) to make a 45-inch wood club, and the golf club was mounted on a swing robot and hit golf balls 10000 times at the maximum at the head speed of 54 meter/second.

The results are shown in Table 1, wherein "A" means that no damage was found after the 10000-time hitting test, and numerical values mean the number of hits at which the face portion was broken.

From the test results, it was confirmed that the durability and strength of the face portion can be significantly improved even though the thickness is decreased.

As has been explained hereinabove, the present invention is suitably applied to wood-type hollow metal heads. But it is also possible to apply the invention to various heads, for instance iron-type heads, as far as a hollow is formed behind the club face.

TABLE 1

Figure 6A:
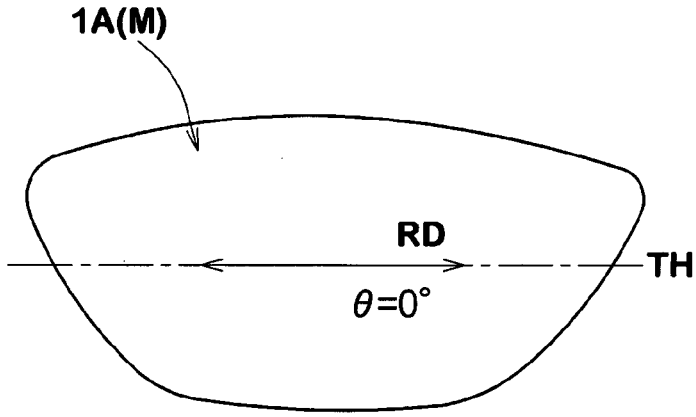
FIGS. 6*a*, 6*b* and 6*c* each show the outline of the club face and the rolled direction of the face plate.
Figure 6B:
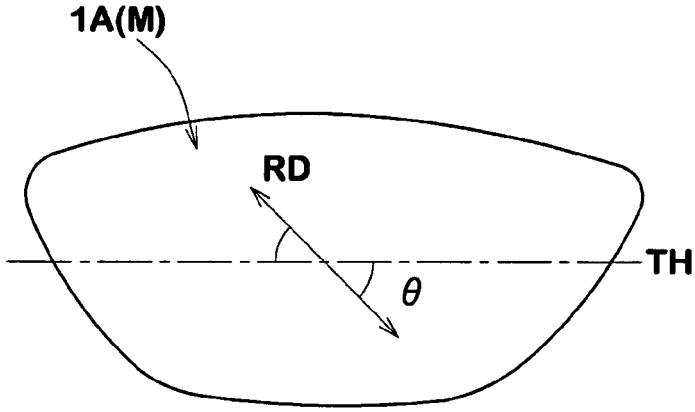
Figure 6C:
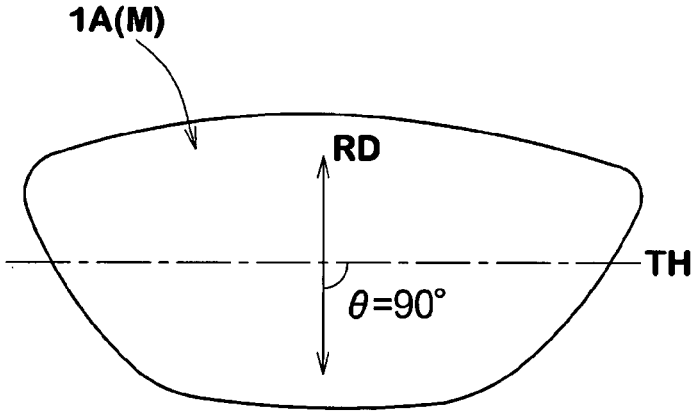

| Head | Ex. 1 | Ex. 2 | Ex. 3 | Ex. 4 | Ex. 5 | Ex. 6 | Ref. 1 | Ref. 2 |
|---|---|---|---|---|---|---|---|---|
| Rolled plate | | | | | | | | |
| Tensile strength | | | | | | | | |
| Spd (MPa) | 1310 | 1310 | 1310 | 1310 | 1310 | 1310 | 1310 | 1310 |
| Srd (MPa) | 1020 | 1020 | 1020 | 1020 | 1020 | 1020 | 1020 | 1020 |
| Spd/Srd | 1.28 | 1.28 | 1.28 | 1.28 | 1.28 | 1.28 | 1.28 | 1.28 |
| Tensile elastic modulus | | | | | | | | |
| Epd (GPa) | 135 | 135 | 135 | 135 | 135 | 135 | 135 | 135 |
| Erd (GPa) | 113 | 113 | 113 | 113 | 113 | 113 | 113 | 113 |
| Epd/Erd | 1.19 | 1.19 | 1.19 | 1.19 | 1.19 | 1.19 | 1.19 | 1.19 |
| Face plate | | | | | | | | |
| Angle theta (deg.) | 0 | 0 | 0 | 10 | 15 | 0 | 45 | 90 |
| | FIG. 6a | FIG. 6a | FIG. 6a | FIG. 6b | FIG. 6b | FIG. 6a | FIG. 6b | FIG. 6c |
| Thickness | | | | | | | | |
| ta (mm) | 2.50 | 2.67 | 2.77 | 2.79 | 2.79 | 2.68 | 2.63 | 2.66 |
| t1 (mm) | 2.96 | 3.05 | 3.14 | 3.15 | 3.15 | 3.07 | 3.00 | 3.05 |
| t2 (mm) | 2.35 | 2.40 | 2.51 | 2.50 | 2.53 | 2.44 | 2.37 | 2.39 |
| Method *1 | cutting | cutting | cutting | cutting | cutting | plastic forming | cutting | cutting |
| Restitution coefficient | 0.822 | 0.819 | 0.810 | 0.812 | 0.814 | 0.822 | 0.824 | 0.828 |
| Durability | A | A | A | A | A | A | 9500 | 8110 |

*1 Method or decreasing the thickness

Cutting: NC milling machine

Plastic forming: Die press machine comprising the dies shown in FIGS. 10-11.

The invention claimed is:

1. A golf club head comprising a face portion of which front face defines a club face, a crown portion, a sole portion, a side portion between the crown portion and sole portion, and a hosel portion, wherein said golf club head has a hollow shell structure with a thin wall and is composed of a main shell body provided with a front opening and a face plate covering the front opening, wherein the face plate is provided around its main portion with a turnback, and the main portion of the face plate forms the entirety of the face portion, whereby the main shell body includes a major part of the golf club head excluding the face portion and a portion corresponding to the turnback, wherein the face plate is made of a unidirectionally rolled plate of a titanium alloy, the titanium alloy is an alpha+beta titanium alloy selected from a group consisting of Ti-4.5Al-3V-2Fe-2Mo, Ti-4.5Al-2Mo-1.6V-0.5Fe-0.3Si-0.03C, Ti-1Fe-0.35O-0.01N, Ti-8Al-1Mo, Ti-5.5Al-1Fe, Ti-6Al-4V, Ti-6Al-6V-2Sn, Ti-6Al-2Sn-4Zr-6Mo, Ti-6Al-2Sn-4Zr-2Mo, and Ti-8Al-1Mo-1V, and the unidirectionally rolled plate is unidirectionally rolled in a unidirectional rolled direction, the unidirectional rolled direction of the plate is oriented in a toe-heel direction of the head so that an angle between the unidirectional rolled direction and the toe-heel direction becomes at most 15 degrees, wherein a tensile strength Spd of the unidirectionally rolled plate in a direction perpendicular to the unidirectional rolled direction is not less than 1.20 times, but not more than 1.60 times a tensile strength Srd of the unidirectionally rolled plate in the unidirectional rolled direction, and said club face has an aspect ratio of not less than 1.65 but not more than 2.10, wherein the aspect ratio is a ratio (FW/FH) of a width FW of the club face measured in the toe-heel direction along the club face passing through a sweet spot to a height FH of the club face measured in a crown-sole direction along the club face passing through the sweet spot.

2. The golf club head according to claim 1, wherein the tensile strength Spd is not less than 1000 MPa, but not more than 1400 MPa, and the tensile strength Srd is not less than 800 MPa, but not more than 1200 MPa.

3. The golf club head according to claim 1, wherein the tensile elastic modulus Epd is not less than 115 GPa, but not more than 145 GPa, and the tensile elastic modulus Erd is not less than 95 GPa, but not more than 125 GPa.

4. The golf club head according to claim 1, wherein the face portion is provided with a thicker central part having a substantially constant thickness in a range of from 2.80 mm to 3.30 mm, and a thin part surrounding the thicker central part and having a substantially constant thickness in a range of from 2.10 mm to 2.60 mm.

5. The golf club head according to claim 1, wherein the average thickness of the face portion is not less than 2.35 mm but not more than 2.75 mm.

6. The golf club head according to claim 1, wherein the main shell body is formed by casting a metal material selected from stainless steels, maraging steels, titanium alloys, aluminum alloys and magnesium alloys.

7. A golf club head comprising a face portion of which front face defines a club face, a crown portion, a sole portion, a side portion between the crown portion and sole portion, and a hosel portion, wherein said golf club head has a hollow shell structure with a thin wall and is composed of a main shell body provided with a front opening and a face plate covering the front opening, wherein the face plate is provided around its main portion with a turnback, and the main portion of the face plate forms the entirety of the face portion, whereby the main shell body includes a major part of the golf club head excluding the face portion and a portion corresponding to the turnback, wherein the face plate is made of a unidirectionally rolled plate of a titanium alloy, the titanium alloy is an alpha+beta titanium alloy selected from a group consisting of Ti-4.5Al-3V-2Fe-2Mo, Ti-4.5Al-2Mo-1.6V-0.5Fe-0.3Si-0.03C, Ti-1Fe-0.35O-0.01N, Ti-8Al-1Mo, Ti-5.5Al-1Fe, Ti-6Al-4V, Ti-6Al-6V-2Sn, Ti-6Al-2Sn-4Zr-6Mo, Ti-6Al-2Sn-4Zr-2Mo, and Ti-8Al-1Mo-1V, and the unidirectionally rolled plate is unidirectionally rolled in a unidirectional rolled direction, the unidirectional rolled direction of the plate is oriented in a toe-heel direction of the head so that an angle between the unidirectional rolled direction and the toe-heel direction becomes at most 15 degrees, wherein a tensile elastic modulus Epd of the unidirectionally rolled plate in a direction perpendicular to the unidirectional rolled direction is not less than 1.10 times, but not more than 1.35 times a tensile elastic modulus Erd of the unidirectionally rolled plate in the unidirectional rolled direction, and said club face has an aspect ratio of not less than 1.65 but not more than 2.10, wherein the aspect ratio is a ratio (FW/FH) of a width FW of the club face measured in the toe-heel direction along the club face passing through a sweet spot to a height FH of the club face measured in a crown-sole direction along the club face passing through the sweet spot.

8. The golf club head according to claim 7, wherein the tensile strength Spd is not less than 1000 MPa, but not more than 1400 MPa, and the tensile strength Srd is not less than 800 MPa, but not more than 1200 MPa.

9. The golf club head according to claim 7, wherein the face portion is provided with a thicker central part having a substantially constant thickness in a range of from 2.80 mm to 3.30 mm, and a thin part surrounding the thicker central part and having a substantially constant thickness in a range of from 2.10 mm to 2.60 mm.

10. The golf club head according to claim 7, wherein the tensile elastic modulus Epd is not less than 115 GPa, but not more than 145 GPa, and the tensile elastic modulus Erd is not less than 95 GPa, but not more than 125 GPa.

11. The golf club head according to claim 7, wherein the average thickness of the face portion is not less than 2.35 mm but not more than 2.75 mm.

12. The golf club head according to claim 7, wherein the main shell body is formed by casting a metal material selected from stainless steels, maraging steels, titanium alloys, aluminum alloys and magnesium alloys.

13. A golf club head comprising a face portion of which front face defines a club face, a crown portion, a sole portion, a side portion between the crown portion and sole portion, and a hosel portion, wherein said golf club head has a hollow shell structure with a thin wall and is composed of a main shell body provided with a front opening and a face plate covering the front opening, wherein the face plate is provided around its main portion with a turnback, and the main portion of the face plate forms the entirety of the face portion, whereby the main shell body includes a major part of the golf club head excluding the face portion and a portion corresponding to the turnback, wherein the face plate is made of a unidirectionally rolled plate of a titanium alloy, the titanium alloy is an alpha+beta titanium alloy selected from a group consisting of Ti-4.5Al-3V-2Fe-2Mo, Ti-4.5Al-2Mo-1.6V-0.5Fe-0.3Si-0.03C, Ti-1Fe-0.35O-0.01N, Ti-8Al-1Mo, Ti-5.5Al-1Fe, Ti-6Al-4V, Ti-6Al-6V-2Sn, Ti-6Al-2Sn-4Zr-6Mo, Ti-6Al-2Sn-4Zr-2Mo, and Ti-8Al-1Mo-1V, and the unidirectionally rolled plate is unidirectionally rolled in a unidirectional rolled direction, the unidirectional rolled direction of the plate is oriented in a toe-heel direction of the head so that an angle between the unidirectional rolled direction and the toe-heel direction becomes at most 15 degrees, wherein a tensile strength Spd of the unidirectionally rolled plate in a direction perpendicular to the unidirectional rolled direction is not less than 1.20 times, but not more than 1.60 times a tensile strength Srd of the unidirectionally rolled plate in the unidirectional rolled direction, and a tensile elastic modulus Epd of the unidirectionally rolled plate in the direction perpendicular to the unidirectional rolled direction is not less than 1.10 times, but not more than 1.35 times a tensile elastic modulus Erd of the unidirectionally rolled plate in the unidirectional rolled direction, and said club face has an aspect ratio of not less than 1.65 but not more than 2.10, wherein the aspect ratio is a ratio (FW/FH) of a width FW of the club face measured in the toe-heel direction along the club face passing through a sweet spot to a height FH of the club face measured in a crown-sole direction along the club face passing through the sweet spot.

14. The golf club head according to claim 13, wherein the tensile strength Spd is not less than 1000 MPa, but not more than 1400 MPa, and the tensile strength Srd is not less than 800 MPa, but not more than 1200 MPa.

15. The golf club head according to claim 13, wherein the face portion is provided with a thicker central part having a substantially constant thickness in a range of from 2.80 mm to 3.30 mm, and a thin part surrounding the thicker central part and having a substantially constant thickness in a range of from 2.10 mm to 2.60 mm.

16. The golf club head according to claim 13, wherein the tensile elastic modulus Epd is not less than 115 GPa, but not more than 145 GPa, and the tensile elastic modulus Erd is not less than 95 GPa, but not more than 125 GPa.

17. The golf club head according to claim 13, wherein the tensile strength Spd is not less than 1000 MPa, but not more than 1400 MPa, the tensile strength Srd is not less than 800 MPa, but not more than 1200 MPa, the tensile elastic modulus Epd is not less than 115 GPa, but not more than 145 GPa, and the tensile elastic modulus Erd is not less than 95 GPa, but not more than 125 GPa.

18. The golf club head according to claim 13, wherein the average thickness of the face portion is not less than 2.35 mm but not more than 2.75 mm.

19. The golf club head according to claim 13, wherein the main shell body is formed by casting a metal material selected from stainless steels, maraging steels, titanium alloys, aluminum alloys and magnesium alloys.

* * * * *